US005269270A

United States Patent [19]

Suzuki et al.

[11] Patent Number: 5,269,270

[45] Date of Patent: Dec. 14, 1993

[54] FOUR-STROKE CYCLE INTERNAL-COMBUSTION ENGINE

[75] Inventors: Masatoshi Suzuki, Urawa; Takaaki Tsukui, Tokyo; Takashi Ichimura, Tokorozawa, all of Japan

[73] Assignee: Honda Giken Kogyo Kabushiki Kaisha, Tokyo, Japan

[21] Appl. No.: 846,920

[22] Filed: Mar. 6, 1992

[30] Foreign Application Priority Data

Mar. 20, 1991 [JP] Japan ..... 3-80577

[51] Int. Cl.[5] ..... F01L 1/34; F02B 31/00; F02P 15/08

[52] U.S. Cl. ..... 123/310; 123/90.16; 123/308; 123/315; 123/432; 123/193.5; 123/638; 123/661

[58] Field of Search ..... 123/90.15, 90.16, 90.17, 123/90.27, 193.5, 308, 310, 315, 432, 638, 661

[56] References Cited

U.S. PATENT DOCUMENTS

| | | | |
|---|---|---|---|
| 4,177,783 | 12/1979 | Palomeque | 123/638 |
| 4,259,935 | 4/1981 | Nakanishi et al. | 123/661 |
| 4,300,498 | 11/1981 | May | 123/661 |
| 4,535,735 | 8/1985 | Yoshinaga et al. | 123/310 |
| 4,667,636 | 5/1987 | Oishi et al. | 123/90.16 |
| 4,671,228 | 6/1987 | Tomita et al. | 123/432 |
| 4,884,539 | 12/1989 | Ciccarone et al. | 123/310 |
| 4,911,114 | 3/1990 | Konno et al. | 123/90.16 |
| 4,957,076 | 9/1990 | Inoue et al. | 123/90.16 |
| 4,972,814 | 11/1990 | Matsuki et al. | 123/661 |
| 5,007,392 | 4/1991 | Niizato et al. | 123/308 |
| 5,016,592 | 5/1991 | Onodera | 123/308 |
| 5,042,443 | 8/1991 | Romanelli | 123/315 |
| 5,050,557 | 9/1991 | Ishida et al. | 123/308 |

FOREIGN PATENT DOCUMENTS

| | | | |
|---|---|---|---|
| 35114 | 2/1985 | Japan | 123/308 |
| 60-164617 | 8/1985 | Japan . | |

*Primary Examiner*—E. Rollins Cross
*Assistant Examiner*—Weilun Lo
*Attorney, Agent, or Firm*—Armstrong, Westerman, Hattori, McLeland & Naughton

[57] ABSTRACT

A four-stroke cycle internal-combustion engine having two large- and small-diameter intake valves and two large- and small-diameter exhaust valves in one cylinder and mounted with a valve-operating mechanism on either of the intake valve side and the exhaust valve side. Each valve-operating mechanism comprises a first valve-operating cam of a narrow total valve-opening angle and a low lift, a second valve-operating cam of a wide total valve-opening angle and a high lift, a rocker arm for the small-diameter valve in direct engagement with the first valve-operating cam, a rocker arm for the large-diameter valve, and a connecting means capable of simultaneously operatively connecting the second valve-operating cam with the rocker arm for the small-diameter valve and the rocker arm for the large-diameter valve. In each cylinder at least three spark plugs are mounted. The combustion chamber is formed high on one side and low on the other side.

5 Claims, 6 Drawing Sheets

FOUR-STROKE CYCLE INTERNAL-COMBUSTION ENGINE

BACKGROUND OF THE INVENTION

The present invention relates to a four-stroke (otto) cycle internal-combustion engine having a plurality of intake valves and exhaust valves in each cylinder.

DESCRIPTION OF THE PRIOR ART

Heretofore, a four-stroke cycle internal-combustion engine in which at least one large- and at least one small-diameter intake valves and at least one large- and at least one small-diameter exhaust valves are provided and the large-diameter intake and exhaust valves are designed to be kept at rest in accordance with the operating condition of the engine is known, as disclosed for example in Japanese Laid-Open Patent Publication No. Sho 60-164617.

In such an engine as described above , all of the valves are operated during high-speed, high-load operation to raise a volumetric efficiency in order to obtain high engine power output. On the other hand, during low-speed, low-load operation the large-diameter valves are held at rest to increase the flow velocity of an air-fuel mixture to generate a swirl in the combustion chamber, thereby improving fuel combustion efficiency.

Generally, the internal-combustion engine is likely to produce knocking with an increase in a compression ratio, so that in a gasoline engine, the upper limit of the compression ratio is around 12 to 13. The formation of the swirl in the combustion chamber and the use of conventional twin spark plugs are effective to prevent knocking, however, since the effect of these means has a limit, an ignition timing must be retarded. Retarding the ignition timing, however, decreases the engine power output notwithstanding the supply of the same quantity of fuel, thus lowering thermal efficiency, that is, deteriorating fuel consumption.

SUMMARY OF THE INVENTION

The present invention has been accomplished in an attempt to solve the problems mentioned above, and has an object to provide an improved four-stroke cycle internal-combustion engine having valves of different diameters for the purpose of improving power output performance and preventing knocking during low-speed high-load operation or during high compression ratio operation.

In the four-stroke cycle internal-combustion engine according to the present invention, each cylinder has at least one large- and at least one small-diameter intake valves and at least one large- and at least one small-diameter exhaust valves, the large-diameter intake and exhaust valves being designed to be kept at rest (closed) in accordance with the operating condition of the engine. On either of the intake and exhaust valve sides is mounted a valve-operating mechanism which comprises a first valve-operating cam of a narrow total valve-opening angle and a low lift, a second valve-operating cam of a wide total valve-opening angle and a high lift, a rocker arm for the small-diameter valve in direct engagement with the first valve-operating cam, a rocker arm for the large-diameter valve, and a connecting means capable of simultaneously operatively connecting the second valve-operating cam with both the rocker arm for the small-diameter valve and the rocker arm for the large-diameter valve.

In this internal-combustion engine, the second valve-operating cam is disconnected from the rocker arms for the small and large-diameter valves when the engine is operating in a low-speed range or at a low load, in order to rest the large-diameter valve, and at the same time, to operate the small-diameter valve by the first valve-operating cam of narrow total valve-opening angle and low lift, thereby producing a swirl in the combustion chamber to improve fuel combustion.

With the engine operating in the high-speed range or at a high load, the second valve-operating cam is connected to the rocker arms for the small- and large-diameter valves. Since the total valve-opening angle and lift of the second valve-operating cam are larger than those of the first valve-operating cam, the operating of the small-diameter valve is regulated by means of the second valve-operating cam. Thus both the small- and large-diameter valves are operated and the sectional area of the fuel travel path in the small-diameter valve increases, thereby increasing the volumetric efficiency and improving the engine power output performance.

Another feature of the present invention is that the four-stroke cycle internal-combustion engine is provided with at least three spark plugs for each cylinder and the height of each combustion chamber is made high on one side and low on the other side.

Since, in this internal-combustion engine, the combustion chamber is formed high on one side and low on the other side, two kinds of squishes occur in the combustion chamber by movement of the piston, that is, an ordinary squish caused radially inwardly from a peripheral area in the combustion chamber and a squish squeezed out from the side formed low toward the side formed high, thus increasing combustion velocity. Also, since at least three spark plugs are used for ignition, fuel combustion rapidly starts. As the result, knocks (premature detonation) can be avoided effectively during low-speed, high-load operation or at a high compression ratio specification.

Other objects and advantages of the present invention will become apparent upon reading the attached detailed description and upon reference to the drawings.

DESCRIPTION OF THE PREFERRED EMBODIMENTS

Figure 1:
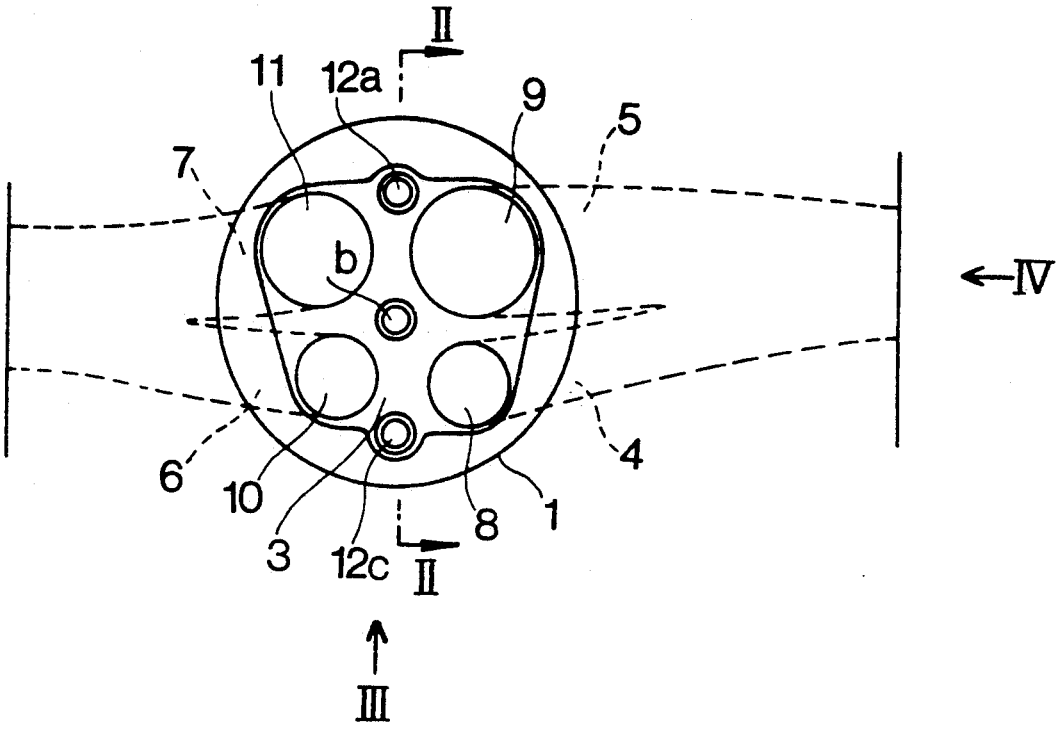
FIG. 1 is a schematic plan view showing a cylinder head of a four-stroke cycle internal-combustion engine of the present invention.
Figure 2:
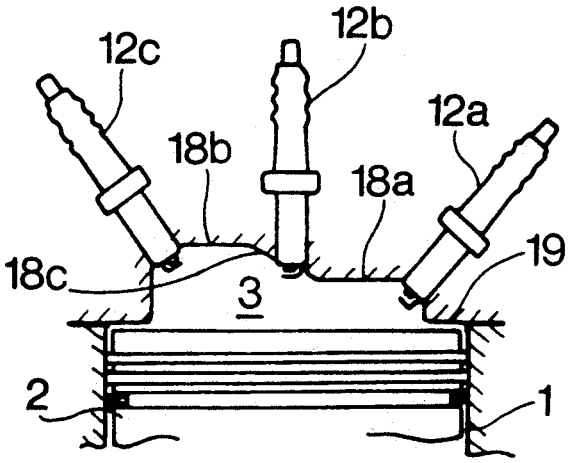
FIG. 2 is a schematic sectional view taken along line II—II of FIG. 1.

FIG. 1 is a schematic plan view showing the cylinder head of a four-stroke cycle internal-combustion engine according to the present invention. FIG. 2 is a schematic sectional view taken along line II—II of FIG. 1, and FIGS. 3 and 4 are schematic views of major portions viewed in the directions of III and IV indicated respectively by the arrows of FIG. 1.

In the above drawings, a numeral 1 denotes a cylinder, a numeral 2 is a piston, and a numeral 3 refers to a combustion chamber. Two intake ports comprising a small-diameter intake port 4 and a large-diameter intake port 5 and two exhaust ports comprising a small-diameter exhaust port 6 and a large-diameter exhaust port 7 are opened on the top wall of the combustion chamber 3. Each opening (valve port) is opened and closed with a small-diameter intake valve 8, a large-diameter intake valve 9, a small-diameter exhaust valve 10 or a large-diameter exhaust valve 11. In the combustion chamber 3 three spark plugs 12*a*, 12*b* and 12*c* are diametrically arranged in one row.

Figure 3:
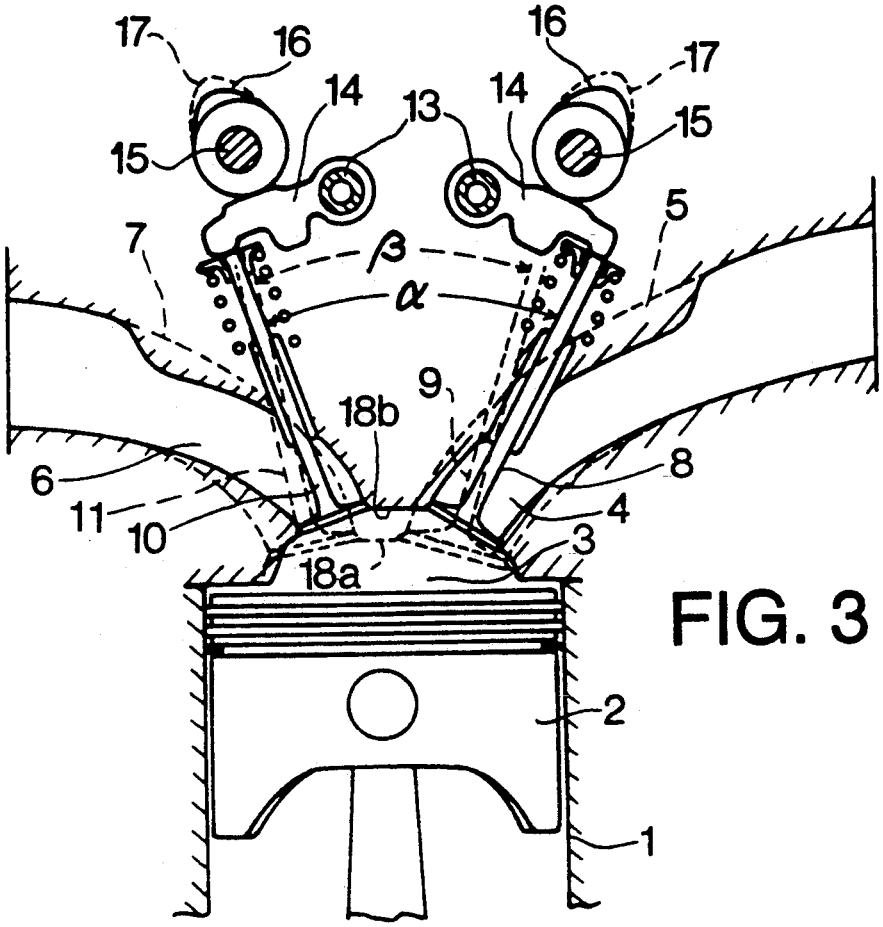
FIG. 3 is a schematic sectional view of a major portion viewed in the direction of III indicated by an arrow of FIG. 1.
Figure 4:
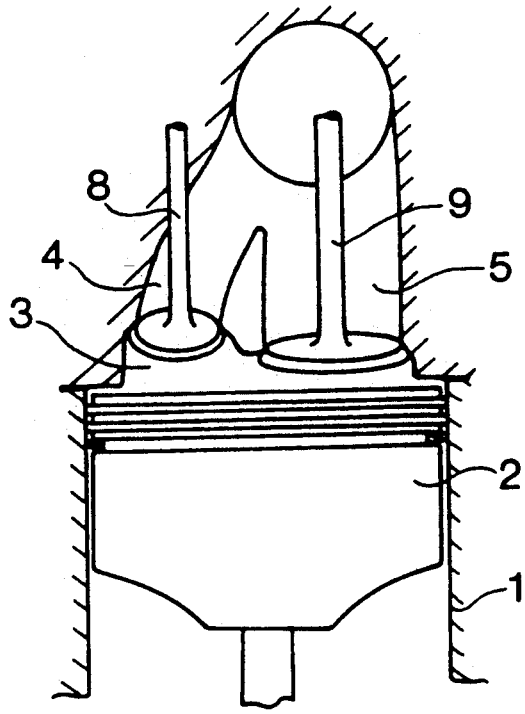
FIG. 4 is a schematic sectional view of a major portion viewed in the direction of IV indicated by an arrow of FIG. 1.

As shown in FIG. 3, the included angle a between the small-diameter intake valve 8 and the small-diameter exhaust valve 10 is set greater than the included angle $\beta$ between the large-diameter intake valve 9 and the large-diameter exhaust valve 11, and similarly the included angle between the small-diameter intake port 4 and the small-diameter exhaust port 6 is set greater than the included angle between the large-diameter intake port 5 and the large-diameter exhaust port 7. Above and inside of the intake valves 8 and 9 also above and inside of the exhaust valves 10 and 11, rocker arm shafts 13 are mounted. On each of these rocker arm shafts 13, rocker arms 14 for operating the valves mentioned above are rockably installed with their one end pivotally fitted. In FIG. 3 only the rocker arms 14 for the small-diameter valves 8 and 10 are shown. Above the rocker arms 14, camshafts 15 extend. On each of the camshafts 15 a couple of cams 16 and 17 are installed at a spacing. The valve-operating mechanism will be further described in detail later.

As is clear from FIG. 2 and 3, the top wall of the combustion chamber 3 consists of a low top wall section 18*a* on the large-diameter valve 9 and 11 side, a high top wall section 18*b* on the small-diameter valve 8 and 10 side, and an intermediate stepped section 18*c* connecting the top wall sections 18*a* and 18*b*. That is, the combustion chamber is formed low on one side and high on the other side. Furthermore, there is formed a narrow clearance 19 between the bottom of the cylinder head around the combustion chamber 3 and the top of the piston when the piston 2 is at top dead center.

Next, the above-described valve-operating mechanism on the intake side will be described in further detail by referring to FIGS. 4 to 7. The valve-operating mechanism on the exhaust side also has an identical construction. On the rocker arm shaft 13 are pivotally mounted rocker arm 14*a* which is in contact with the top of the small-diameter intake valve 8 to operate it and rocker arm 14*b* which is in contact with the top of the large-diameter intake valve 9 to operate it. Furthermore an auxiliary rocker arm 20 is installed between rocker arms 14*a* and 14*b* and similarly pivotally installed on the rocker arm shaft 13. The rocker arm 14*a* corresponds to the rocker arm 14 shown in FIG. 3, which is in direct contact with the first valve-operating cam, that is, the cam 16, mounted on the camshaft 15. The camshaft 15 is further provided with a second valve-operating cam, that is, the cam 17, which is in contact with the auxiliary rocker arm 20.

Figure 7:
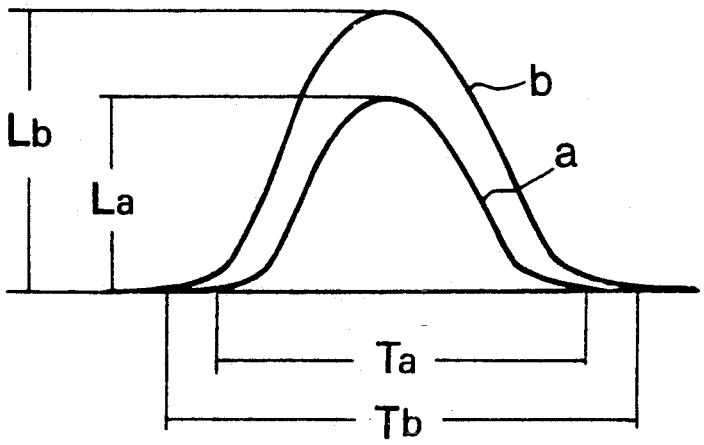
FIG. 7 is a diagram showing valve lift curves of the first and second valve-operating cams.

FIG. 7 is a diagram showing the lift curve a of the cam 16 and the lift curve b of the cam 17. As is seen from this diagram, the total valve-opening angle (duration) Ta of the cam 16 is smaller than the total valve-opening angle Tb of the cam 17, and the amount of lift La of the cam 16 is smaller than the amount of lift Lb of the cam 17, therefore the lift curve a of the cam 16 remains fully inside of the lift curve b of the cam 17.

The rocker arms 14*a*, 20 and 14*b* have a pin hole 21 formed through them in a lateral direction. However, the pin hole sections 21*a* and 21*b* of the rocker arms 14*a* and 14*b* are both made in a form of bottomed cylinder. In the pin hole 21 are slidably fitted a changeover pin 22*a*, a changeover pin 22*b*, and a stopper member 23 relative to the rocker arm 14*a* side. The length of the changeover pin 22*a* is nearly equal to the depth of the pin hole section 21*a*. And the length of the changeover pin 22*b* is nearly equal to the length of the pin hole section 21*c* formed in the auxiliary rocker arm 20. The stopper member 23 is being pressed by the spring 24 toward the changeover pin 22*b* side, and the small-diameter shaft section 23*a* of the stopper member 23 is designed to protrude from the pin hole section 21*b* beyond the side surface of the rocker arm 14*b*.

In the rocker arm shaft 13 which is a hollow shaft, a hydraulic pressure supply passage 25 is formed. The passage 25 communicates with the bottom section of the pin hole section 21*a* through the connecting passage 26. With the removal of a hydraulic pressure from the hydraulic pressure supply passage 25, the changeover pin 22*a* is pressed against the bottom of the pin hole section 21*a* by the spring 24 via the stopper member 23 and the changeover pin 22*b*. The contact surface of the changeover pins 22*a* and 22*b* coincides with that of the rocker arm 14*a* and the auxiliary rocker arm 20, and the contact surface of the changeover pin 22*b* and the stopper member 23 coincides with that of the auxiliary arm 20 and the rocker arm 14*b*. In this state, the rocking motion of the auxiliary rocker arm 20 which is operated by the cam 17 is not transmitted to the rocker arm 14*b* and accordingly the large-diameter intake valve 9 remains stationary. Also, the rocking motion of the same auxiliary rocker arm 20 is not transmitted to the rocker arm 14*a*, which, however, is urged by the cam 16 to operate the small-diameter intake valve 8. This valve operation mode is used when the engine is operating under low loads, in which the air-fuel mixture is drawn into the combustion chamber 3 at a relatively high flow velocity through the small-diameter intake port 4 and the small-diameter intake valve 8 which is opened with a small lift, thereby producing a powerful swirl in the combustion chamber to promote fuel combustion.

Figure 6:
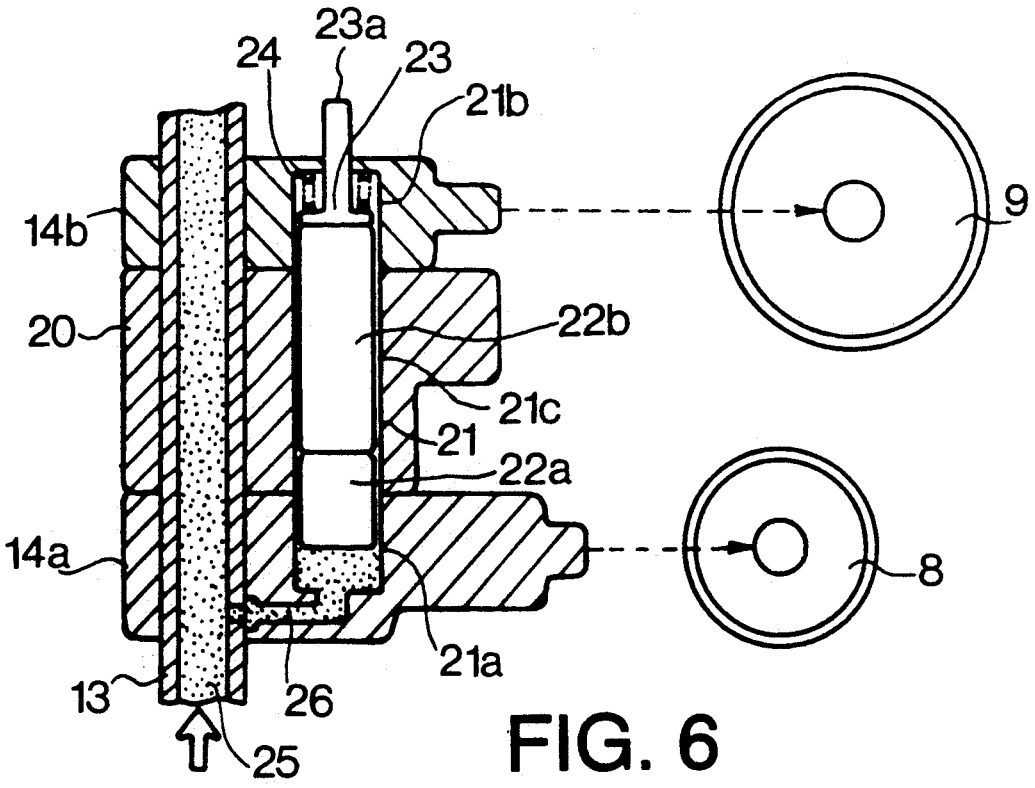
FIG. 6 is a view showing another operation behavior of the valve mechanism.

In the meantime, when the hydraulic pressure is supplied into a hydraulic pressure supply passage 25 it is led to the pin hole section 21*a* through the connecting passage 26, and with this hydraulic pressure the changeover pin 22*a*, the changeover pin 22*b* and the stopper member 23 are pushed upward against the force of the spring 24 as shown in FIG. 6. The changeover pin 22*a* inserted extends on both the rocker arm 14*a* and auxiliary rocker arm 20 sides, and the changeover pin 22*b* inserted also extends on both the auxiliary rocker arm 20 and rocker arm 14*b* sides. Therefore, the rocking motion of the auxiliary rocker arm 20 operated by the cam 17 is transmitted to the rocker arm 14*b* through the changeover pin 22*b*, thus the large-diameter intake valve 9 is operated by the rocker arm 14*b*. Furthermore the rocking motion of the auxiliary rocker arm 20 is transmitted also to the rocker arm 14*a* through the changeover pin 22*a*. Since the lift curves of the cams 16 and 17 are in the relation as previously described, the rocking motion of the rocker arm 14*a* which is imparted by the cam 17 is greater than that imparted by the cam 16. Accordingly, the operation of the rocker arm 14*a* is regulated exclusively by the cam 17, hence the rocker arm 14*a* makes the small-diameter intake valve 8 open for a prolonged period of time at a lager lift than the above-described case when the operation of the rocker arm 14*a* was regulated by the cam 16. Thus the air-fuel mixture is drawn up into the combustion chamber 3 via both the small-diameter intake valve 8 and the large-diameter intake valve 9, and the sectional area of fuel travel path in the small-diameter intake valve 8 increases, thereby enabling insuring a large volumetric efficiency and remarkably improving the engine power output performance. This valve operation mode is used for high-speed, high-load engine operation.

Changeover between the two valve operation modes is performed in accordance with the operating condition of the engine. It may be done using the engine speed Ne as a parameter. That is, in FIG. 10 showing the output characteristic curves of the engine in which the engine speed Ne (rpm) is plotted on the horizontal axis and the volumetric efficiency $\eta v(\%)$ is plotted on the vertical axis, the valve operation is changed over to the large-diameter valve rest mode of FIG. 5 when the engine speed Ne is within the range A in which the engine speed Ne is lower than a predetermined speed, and to the both valves operate mode of FIG. 6 when the engine speed Ne is within the range B in which the engine speed Ne is higher than the predetermined speed.

Figure 10:
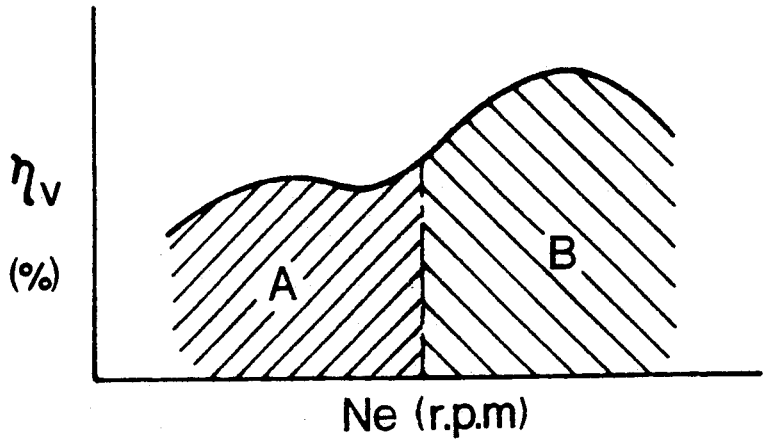
FIG. 10 is an engine power output characteristic curve for explaining one example of switching of valve operation.
Figure 11:
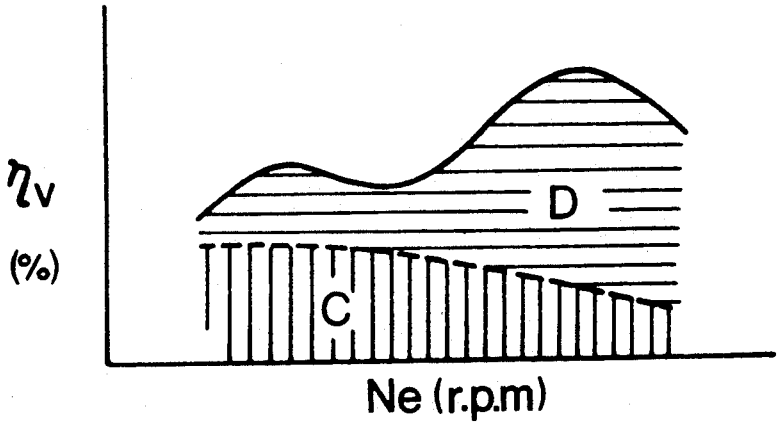
FIG. 11 is a diagram of characteristic curves similar to FIG. 10, for explaining another example of switching of valve operation.

Also, the valve operation mode may be changed to the large-diameter valve rest mode in the low-load range C, and to the both valves operate mode in the high-load range D, as shown in FIG. 11 similar to FIG. 10, using a throttle opening or a load expressed by an intake pipe negative pressure.

Figure 8:
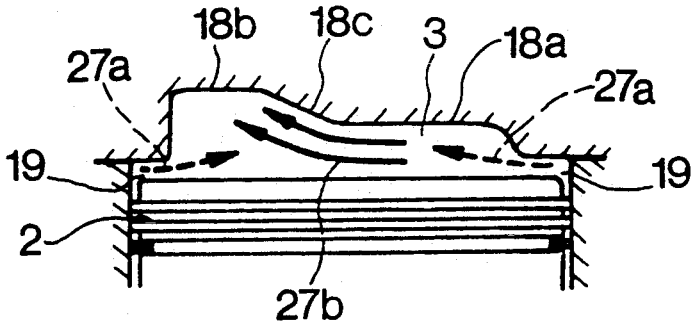
FIG. 8 is a longitudinal sectional schematic view of a combustion chamber.
Figure 9:
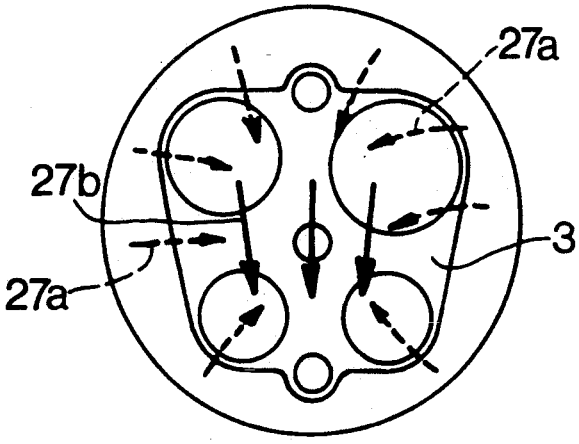
FIG. 9 is a cross sectional schematic view of the combustion chamber.

FIGS. 8 and 9 are schematic illustrations showing squishes formed in the combustion chamber by the piston 2 at the end of compression stroke in the above-described internal-combustion engine. In these drawings, a dotted line 27*a* with an arrow indicates the ordinary squish which is squeezed radially inward from the surrounding clearance 19. In the present embodiment, as the combustion chamber 3 consists of the low top wall section 18*a*, the high top wall section 18*b*, and the stepped section 18*c*, there is formed, besides the ordinary squish 27*a*, a squish 27*b* which is squeezed out from the low top wall section 18*a* toward the high top wall section 18*b*. Owing to the formation of these double squishes 27*a* and 27*b* increasing of the combustion velocity is attainable. In addition to the above, the air-fuel mixture in the combustion chamber 3 is ignited with three spark plugs 12, and therefore combustion can be started rapidly, consequently effectively avoiding knocks during low-speed high-load operation or at high compression ratio specifications.

Figure 5:
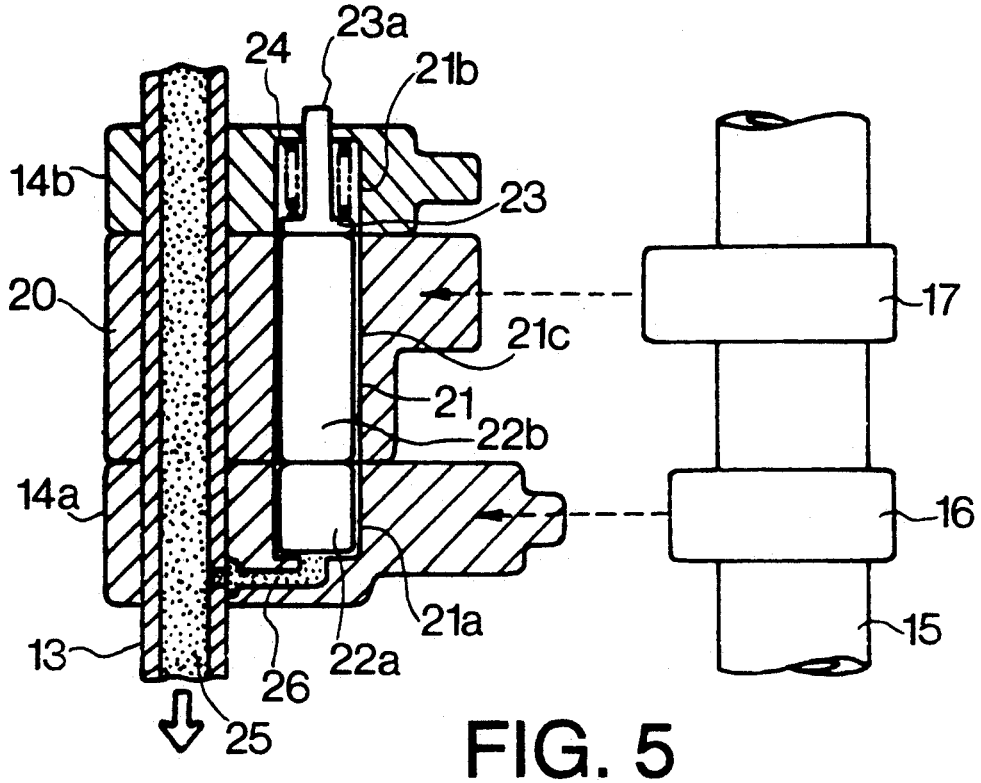
FIG. 5 is a view showing one operation behavior of a valve mechanism.
Figure 12:
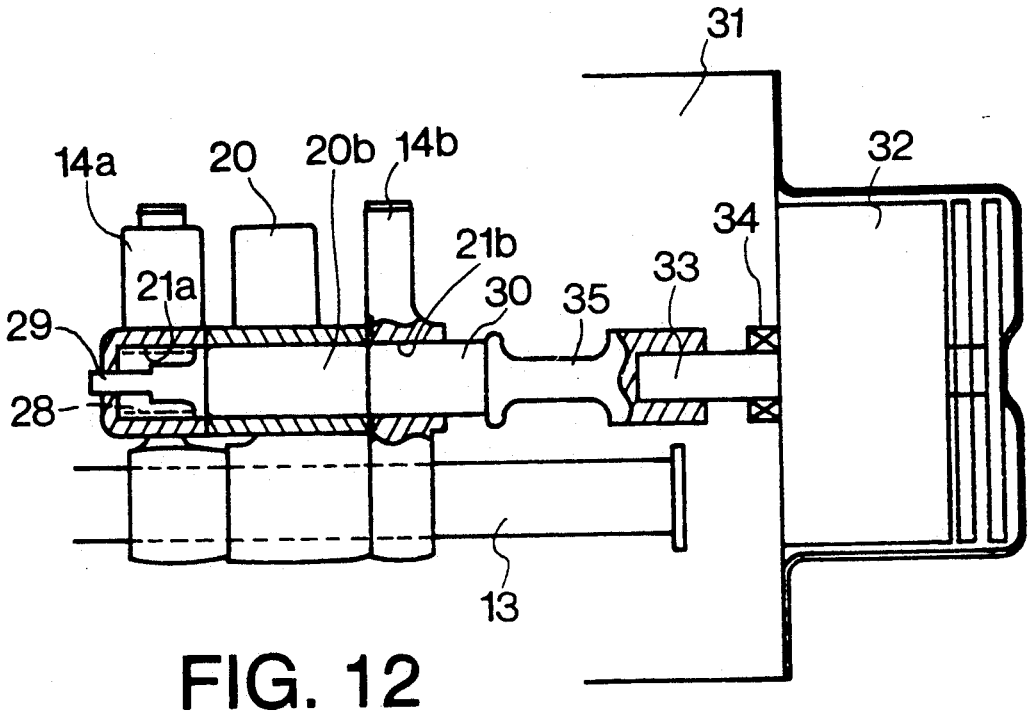
FIG. 12 is a view similar to FIG. 5 showing another embodiment of the present invention.

FIG. 12 is a drawing corresponding to FIG. 5 described above which shows another embodiment of the present invention. In this drawing the same reference numerals are used for the same parts as those appearing in FIG. 5. In the present embodiment, the valve operation mode is changed by means of an electromagnetic device, not by the hydraulic pressure described in the previous embodiment.

In the present embodiment, a stopper member 29 loaded with a spring 28 is fitted in the pin hole section 21*a* of the rocker arm 14*a* which operates the small-diameter valve, and a changeover pin 30 is fitted in the pin hole section 21*b* of the rocker arm 14*b* which operates the large-diameter valve. On the side of the cylinder head cover 31 is mounted an electromagnetic solenoid 32, the spindle 33 of which, sealed with an oil seal 34, projects into the cover 31, and the forward end of a push rod 35 connected to the spindle 33 is in contact with the end face of the changeover pin 30. In the illustrated condition, only the small-diameter valve is operating, but when the spindle 33 of the solenoid 32 projects to push the changeover pin 30, 20*b* through the push rod, the rocker arms 14*a*, 14*b* and 20 are integrally connected, so that both the small- and large-diameter valves will be operated with the cam 17 of large total valve-opening angle and lift.

Figure 13:
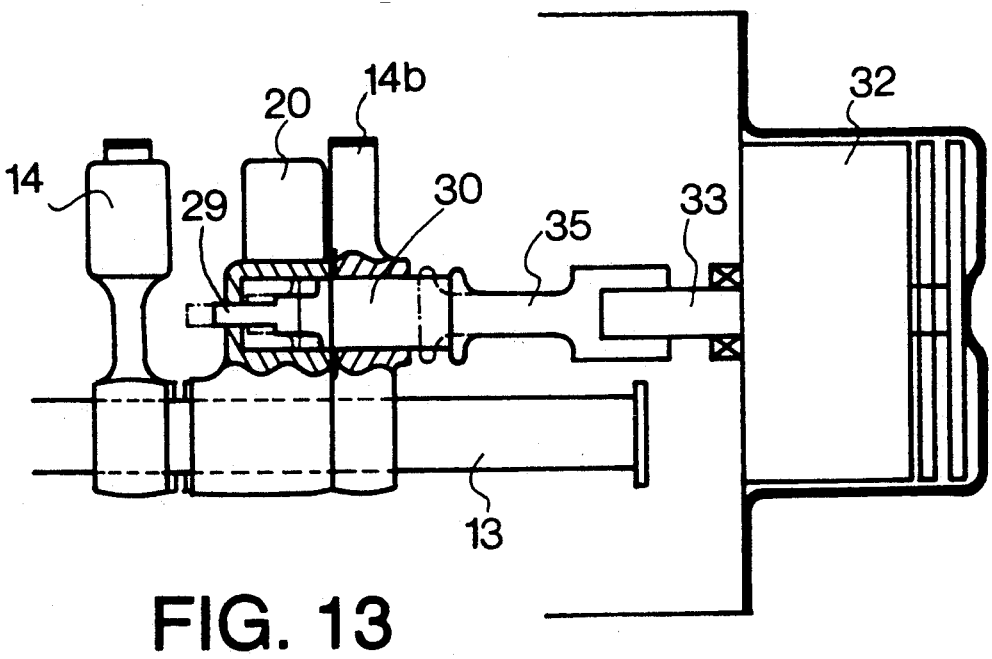
FIG. 13 is a similar view showing a variation of the same embodiment.

Hydraulically operating the changeover pin as described in the before-mentioned embodiment will require a large-capacity oil pump and a power loss will increase. The use of a solenoid as a power source to actuate the changeover pin as in the present embodiment will do much toward decreasing power loss and improving fuel consumption. If the valve-operating mechanism using the solenoid 32 is constituted as shown in FIG. 13, it is also possible that the small-diameter valve is always operated by the cam 16, and in the high-speed range, the auxiliary rocker arm 20 and the rocker arm 14*b* are connected by means of the changeover pin 30 to operate the large-diameter valve by the cam 17.

It is to be understood, however, that the present invention is not limited to the embodiments described above, but various many changes and modifications may be made. For example, there may be installed more than three spark plugs, and also large and small intake and exhaust valves may be arranged in staggered positions in order to facilitate the use of large large-diameter exhaust valves as possible. Furthermore the included angle a between the small-diameter valves may be made smaller than the included angle $\beta$ between the large-diameter valves, or these included angles $\alpha$ and $\beta$ may be made equal.

According to the present invention, as is apparent from the above description, it is possible not only to enhance the engine power output performance but to improve fuel combustion in the combustion chamber during low-load operation. Furthermore, it is possible to effectively avoid knocks during low-speed, high-load operation or at high-pressure compression ratio specification, to thereby improve thermal efficiency to decrease fuel consumption as well.

The present invention has been described in detail with particular reference to preferred embodiments thereof but it will be understood that variations and modifications can be effected within the spirit and scope of the invention.

What is claimed is:

1. A four-stroke cycle internal-combustion engine having at least one large and at least one small-diameter intake valves and at least one large and at least one small-diameter exhaust valves in each cylinder, said small diameter valves being disposed in a first portion of a cylinder head wherein an average distance from a piston at top dead center (TDC) to the first portion of the cylinder head is greater than an average distance from the piston at TDC to a second portion of the cylinder head wherein are disposed the large diameter valves, said larger-diameter intake and exhaust valves being designed to rest in accordance with the operating condition of said engine, in which on either of the intake and exhaust valve sides in mounted a valve-opening mechanism comprising a first valve-operating cam of a narrow total valve-opening angle and a low lift, a second valve-opening cam of a wide total valve-opening angle and a high lift, a rocker arm for said small-diameter valve in direct contact with said first valve-opening cam, a rocker arm for said large diameter valve, and a connecting means capable of simultaneously operatively connecting said second valve-opening cam with said rocker arm for said small-diameter valve and said rocker arm for said large-diameter valve.

2. The four-stroke cycle internal-combustion engine as claimed in claim 1, wherein said connecting means is mounted adjacently to said rocker arm for said small-diameter valve and said rocker arm for said large-diameter valve, and comprises an auxiliary rocker arm in direct engagement with said second valve-operating cam and includes a connecting member capable of connecting said three rocker arms in one body.

3. The four-stroke cycle internal-combustion engine as claimed in claim 2, wherein said connecting member is hydraulically operated.

4. The four-stroke cycle internal-combustion engine as claimed in claim 2, wherein said connecting member is operated by an electromagnetic device.

5. The four-stroke cycle internal-combustion engine as claimed in claim 1, at lest one spark plug being disposed in the first portion of said cylinder head wherein said small diameter intake and exhaust valves are located.

* * * * *